US011186391B2

(12) United States Patent
Hsieh

(10) Patent No.: US 11,186,391 B2
(45) Date of Patent: Nov. 30, 2021

(54) AUTOMATIC CAPPING MACHINE FOR CONTAINERS

(71) Applicant: VIGOURPLASTIC CO., LTD., Changhua County (TW)

(72) Inventor: Albert Hsieh, Changhua County (TW)

( * ) Notice: Subject to any disclaimer, the term of this patent is extended or adjusted under 35 U.S.C. 154(b) by 204 days.

(21) Appl. No.: 16/525,194

(22) Filed: Jul. 29, 2019

(65) Prior Publication Data

US 2021/0031954 A1 Feb. 4, 2021

(51) Int. Cl.
*B65B 7/26* (2006.01)
*B65B 59/00* (2006.01)

(52) U.S. Cl.
CPC ..... *B65B 7/26* (2013.01); *B65B 59/005* (2013.01)

(58) Field of Classification Search
CPC ..... B65B 43/52; B65B 59/005; B65B 7/26; B65B 7/285; B65B 59/003
See application file for complete search history.

(56) References Cited

U.S. PATENT DOCUMENTS 5,687,543 A * 11/1997 Lam ..... B65B 51/067 53/136.4
7,073,308 B2 * 7/2006 Dyke ..... B65B 7/285 53/377.6
2005/0132666 A1 * 6/2005 Dyke ..... B65B 7/285 53/377.6
2009/0193766 A1 * 8/2009 Dyke ..... B65B 7/26 53/476
2018/0346158 A1 * 12/2018 Dyke ..... B65B 7/26

* cited by examiner

*Primary Examiner* — Andrew M Tecco
*Assistant Examiner* — Nicholas E Igbokwe
(74) *Attorney, Agent, or Firm* — Egbert, McDaniel & Swartz, PLLC

(57) ABSTRACT

An automatic capping machine for containers includes a main frame body with a workbench having a bottom conveyor belt disposed thereon, and a lining plate provided below the conveying side of the bottom conveyor belt. A fixed track and a rolling mechanism are disposed on the workbench, and there is a gap between the rolling surface of the rolling mechanism and the fixed track. At least one rolling gap is relatively defined and formed by the space between the rolling surface and the fixed track. The lateral state maintaining structure of a container is disposed above the conveying side of the bottom conveyor belt, so that the convex frame edge of the box body of the container is maintained and limited above the fixed track. A through air collision avoidance section is formed in the rolling section defined on the setting path of the lining plate.

6 Claims, 8 Drawing Sheets

AUTOMATIC CAPPING MACHINE FOR CONTAINERS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an automatic machine; and more particularly to an automatic capping machine for a container.

2. Description of Related Art Including Information Disclosed Under 37 CFR 1.97 and 37 CFR 1.98

A plastic vacuum forming container generally used for packaging foods (or other products) on the market commonly consists of a box body and a cap body. Some of the box body and the cap body are connected through one side to form a cap body in the state of being lifted up, some of the box body and the cap body are completely separated from each other, and after the goods are put in the box body, the cap body is capped on the box body.

At present, most of the containers in the packaging process still rely entirely on manpower for loading and capping of the goods, so in terms of packaging efficiency and quality stability, it is often difficult to meet the requirements of relevant industries, and the cap body and the box body of such containers are usually designed with a buckle positioning structure with the identification effect for preventing the illegal opening. The buckle positioning structure requires the state consistency when the buckle is engaged, so it is easy by the manpower because the force applied is inconsistent, resulting in unstable packaging quality in the future.

On the other hand, the reason why the automatic capping operation of the above-mentioned plastic vacuum forming container is not popular may be also because the container is usually thin shell-shaped, so the structural rigidity is not good, and if the existing rolling mechanism is directly used for the automatic capping operation of the container, which may cause the container structure to be deformed due to extrusion or even damaged during the capping process.

BRIEF SUMMARY OF THE INVENTION

The main object of the present invention is to provide an automatic capping machine for a container, and the technical problem to be solved is to aim at how to develop a new type automatic capping machine structure for a container which is more ideal and practical in thinking about innovative breakthroughs. The automatic capping machine for a container is used for capping the container. The container has a box body and a cap body, and the opening above the box body is provided with a convex frame edge for the cap body capped on the convex frame edge.

Based on the foregoing object, the technical features of the present invention for the problem to be solved mainly in the automatic capping machine for a container include: a main frame body, including a positioning part and a workbench; a bottom conveyor belt, which is moved circularly along an axial direction and disposed horizontally on the workbench, so that the bottom conveyor belt is disposed in a circular shape between the at least two rotating wheels, which forms the bottom conveyor belt to define a conveying side and a returning side of the upper and lower interval arrangement relationship, and the height state of the conveying side is provided with the automatic resetting capability; at least one lining plate is disposed under the conveying side of the bottom conveyor belt and along a running path of the conveying side, so as to support and limit a minimum height state of the conveying side during running, and a rolling section is defined on the setting path of at least one lining plate; at least one fixed track is horizontally disposed on the workbench of the main frame body, so that at least one fixed track and the bottom conveyor belt are set to be the same in the guiding direction of the container, and at least one fixed track is located above at least one side of the bottom conveyor belt at a predetermined interval height position; at least one rolling mechanism is horizontally disposed on the workbench of the main frame body, so that at least one rolling mechanism and the bottom conveyor belt are set to be the same in the guiding direction of the container, and at least one rolling mechanism is located above at least one fixed track at a predetermined height position, each rolling mechanism includes a rolling surface, and the rolling surface has a spacing distance from the corresponding fixed track below; at least one rolling gap is defined and formed by the spacing distance of the corresponding fixed track below the rolling surface, and the height of at least one rolling gap is matched with the thickness of the convex frame edge of the box body of the container; a container's lateral state maintaining structure is disposed above the conveying side of the bottom conveyor belt, so that the convex frame edge of the box body of the container is maintained and limited above the fixed track; and a through air collision avoidance section is formed on the rolling section defined by the setting path of at least one lining plate, and the upward orthographic projection range of the through air collision avoidance section must at least cover the rolling surface of the rolling mechanism, so that when the container is transported to the corresponding through air collision avoidance section, the bottom of the box body and the corresponding bottom conveyor belt area have an elastic margin that can be pressed and lowered, and the elastic margin is smaller than the minimum interval distance between the conveying side and the return side of the bottom conveyor belt.

The main effect and advantage of the present invention are to provide an innovative structure of the automatic capping machine for a container, the rolling part is a rolling gap formed by the relative distance between the rolling surface of the rolling mechanism and the fixed track, the convex frame edge disposed in the box body of the container and the cap body are rolled; furthermore, the box body bottom and the corresponding bottom conveyor belt area have the elastic margin that can be lowered under the pressure by the through air collision avoidance section, so that the structural rigidity of the container's box body can be ensured, the deformation can be prevented, and the frictional force that can be driven by the box body can be considered to be practical and progressive.

DETAILED DESCRIPTION OF THE INVENTION

Please refer to FIG. 1-FIG. 9 for preferred embodiments of the automatic capping machine for containers of the present invention. However, these embodiments are for illustrative purposes only and are not limited by this structure in the patent application.

The automatic capping machine for container A is used for capping the predetermined container 10. The container 10 includes a box body 11 and a cap body 12, and the upper opening of the box body 11 is provided with a convex frame edge 13, so that the cap body 12 is capped on the convex frame edge 13.

Figure 7:
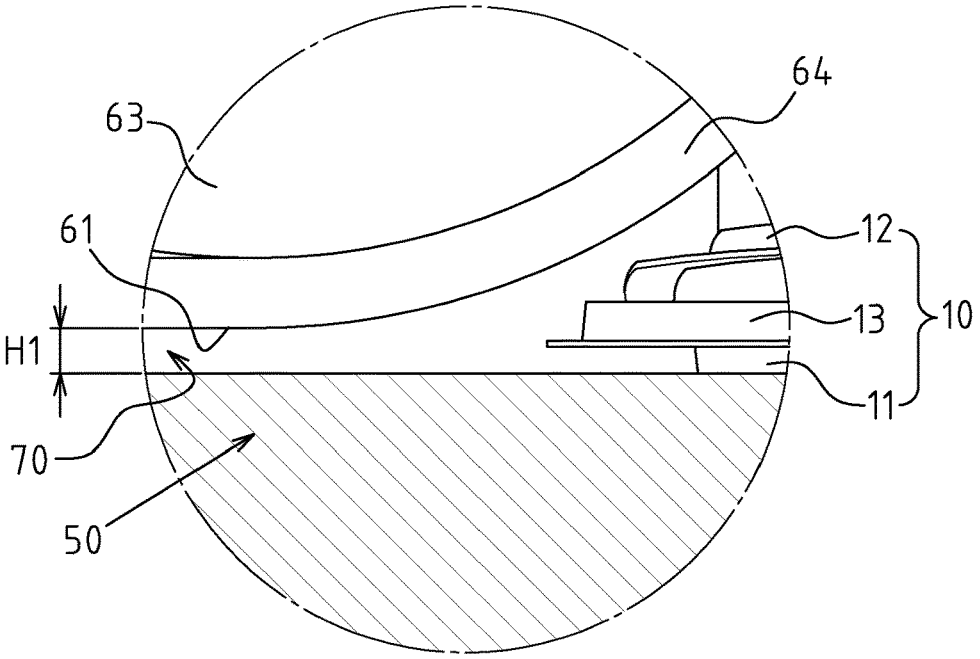
FIG. 7 is a partial enlargement diagram of FIG. 6.
Figure 8:
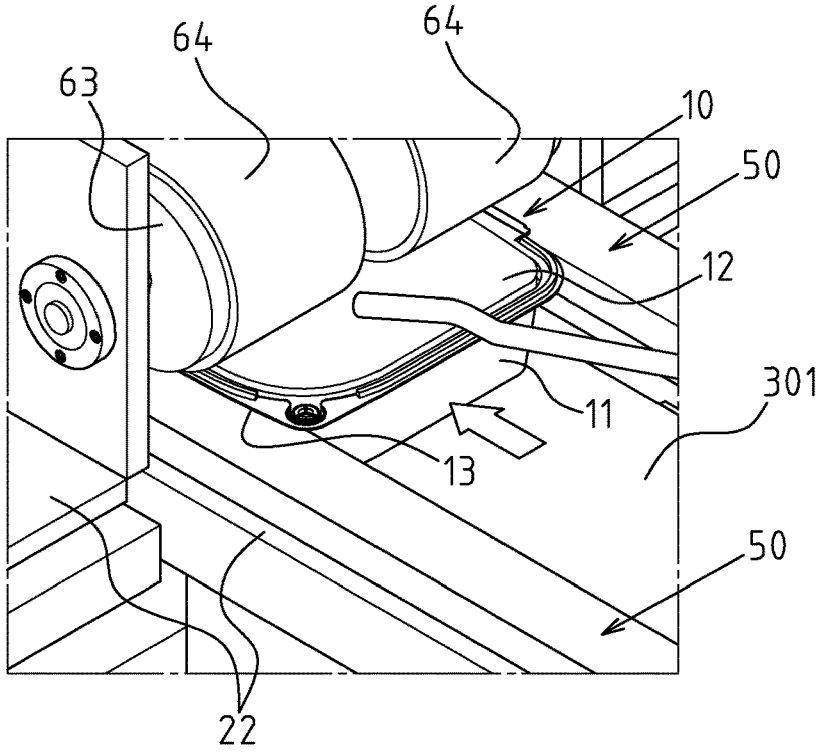
FIG. 8 is a schematic diagram 2 of the embodiment of the present invention, which is a three-dimensional diagram.

The automatic capping machine for containers A includes the following components: a main frame body 20 including a positioning part 21 and a workbench 22; a bottom conveyor belt 30 is horizontally disposed on the workbench 22 in a circular shape along an axial direction, so that the bottom conveyor belt 30 is disposed in a circular shape between the at least two rotating wheels 31 and 32, which forms the bottom conveyor belt 30 to define a conveying side 301 and a returning side 302 of the upper and lower interval arrangement relationship, and the height state of the conveying side 301 is provided with the automatic resetting capability; at least one lining plate 40 is disposed under the conveying side 301 of the bottom conveyor belt 30 and along a running path of the conveying side 301 for supporting and limiting a minimum height state of the conveying side 301 during operation, and a setting path of the at least one lining plate 40 defines a rolling section 41 (only shown in FIG. 4); at least one fixed track 50 is disposed horizontally on the workbench 22 of the main frame body 20, so that the fixed track 50 and the bottom conveyor belt 30 are set to be the same in the guiding direction of the container 10, and the fixed track 50 is located above at least one side of the bottom conveyor belt 30 at a predetermined interval height position; the at least one rolling mechanism 60 is horizontally disposed on the workbench 22 of the main frame body 20, so that the rolling mechanism 60 and the bottom conveyor belt 30 are set to be the same in the guiding direction of the container 10, and the at least one rolling mechanism 60 is located at least a predetermined height position above a fixed track 50, each rolling mechanism 60 includes a rolling surface 61, and the rolling surface 61 has a spacing distance H1 from the corresponding fixed track 50 below (as shown in FIG. 7); the at least one rolling gap 70 is defined and formed by the spacing distance H1 of the corresponding fixed track 50 below the rolling surface 61, and the height of at least one rolling gap 70 is matched with the thickness of the convex frame edge 13 of the box body 11 of the container 10; a container's lateral state maintaining structure (note: the specific structure is described later in detail) is disposed above the conveying side 301 of the bottom conveyor belt 30, so that the convex frame edge 13 of the box body 11 of the container 10 is maintained and limited above the fixed track 50; and a through air collision avoidance section 80 is formed on the rolling section 41 defined by the setting path of at least one lining plate 40, and the upward orthographic projection range of the through air collision avoidance section 80 must at least cover the rolling surface 61 of the rolling mechanism 60, so that when the container 10 is transported to the corresponding through air collision avoidance section 80, the bottom of the box body 11 and the corresponding bottom conveyor belt 300 area have an elastic margin that can be pressed and lowered (see FIG. 9), and the elastic margin is smaller than the minimum interval distance between the conveying side 301 and the return side 302 of the bottom conveyor belt 30.

Figure 1:
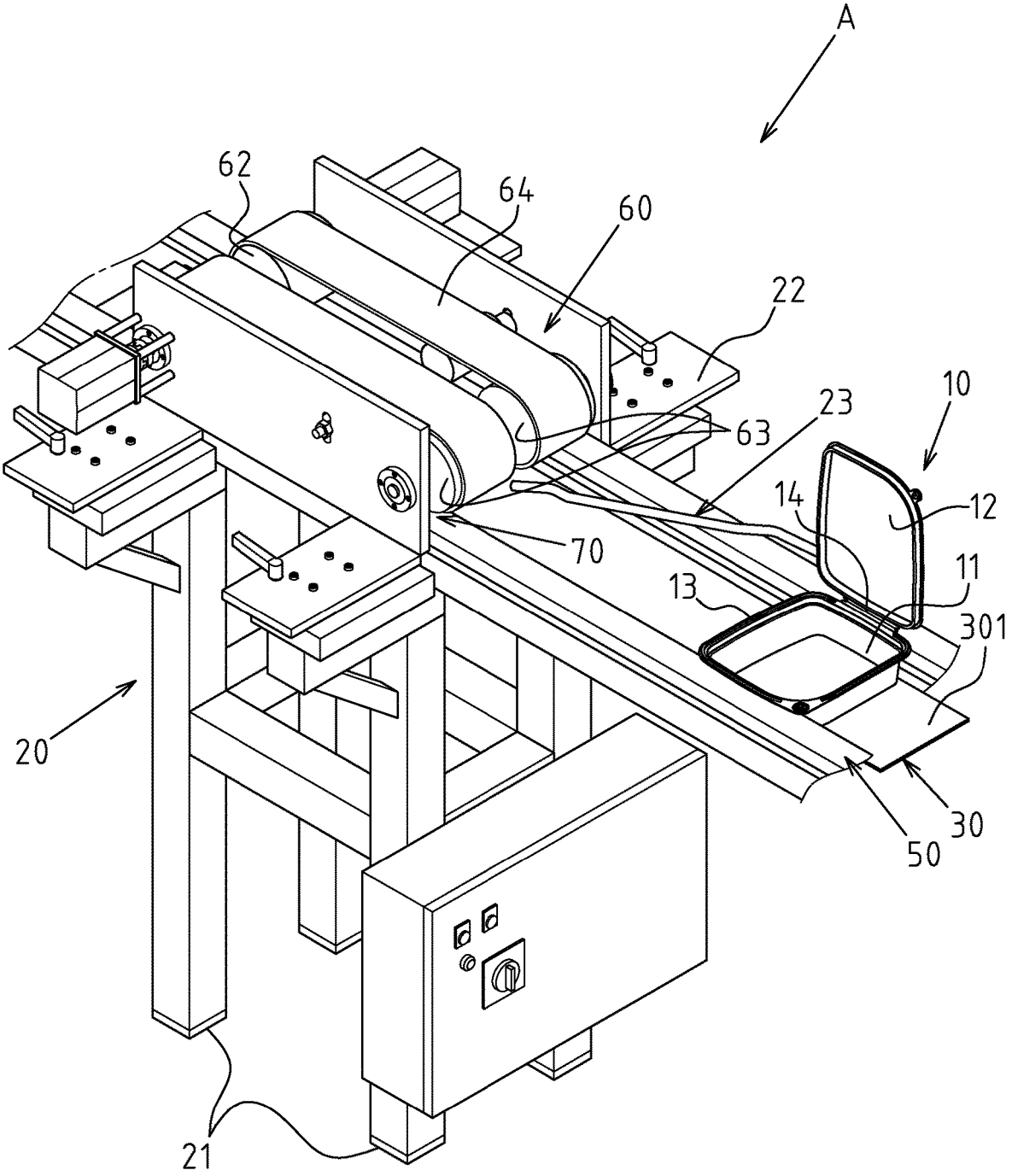
FIG. 1 is a perspective view of the automatic capping machine for containers of the present invention.
Figure 3:
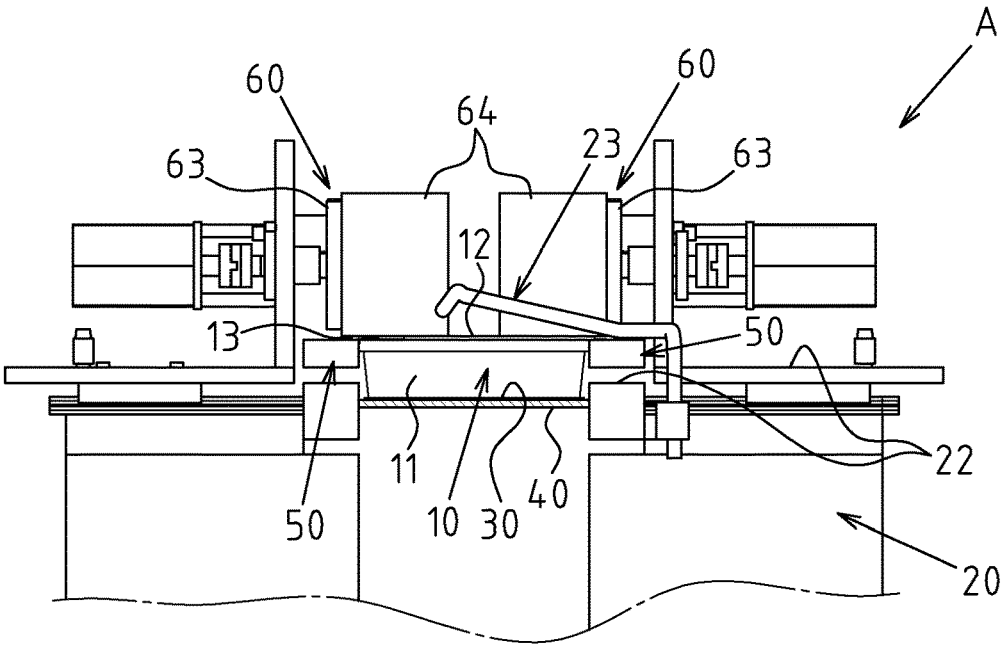
FIG. 3 is a side view of the main part of the preferred embodiment of the present invention.
Figure 4:
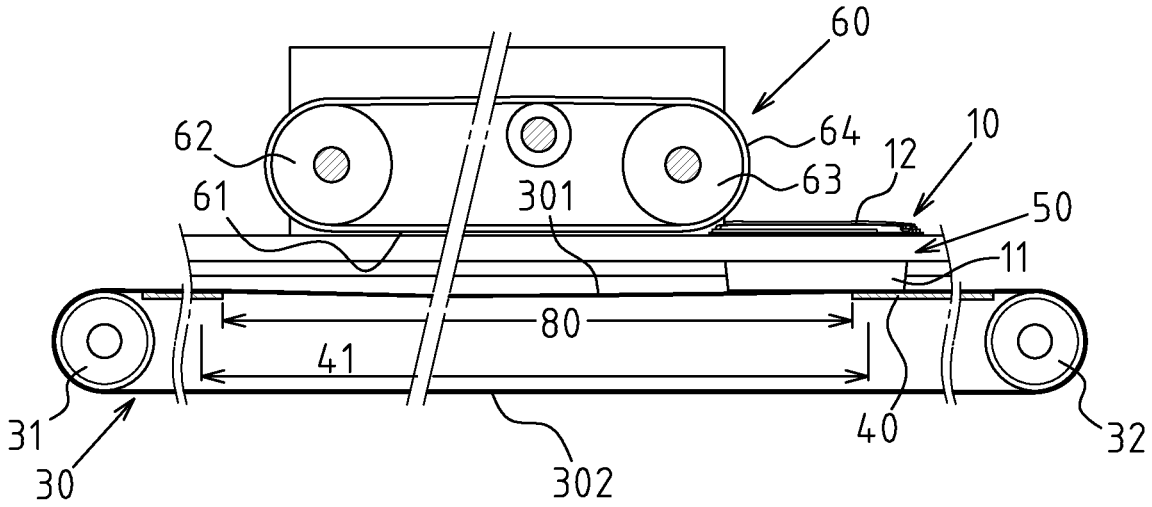
FIG. 4 is a vertical sectional view of a partial structure of a preferred embodiment of the present invention.
Figure 5:
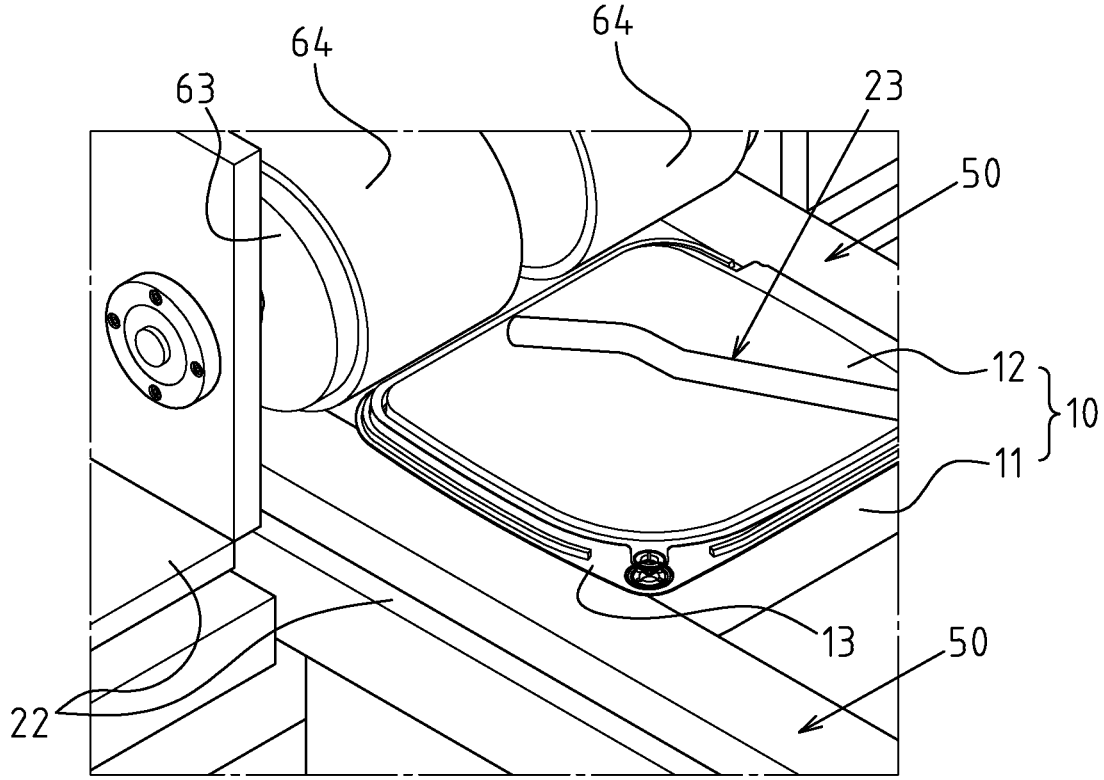
FIG. 5 is a schematic diagram 1 of the embodiment of the present invention, which is a three-dimensional diagram.
Figure 6:
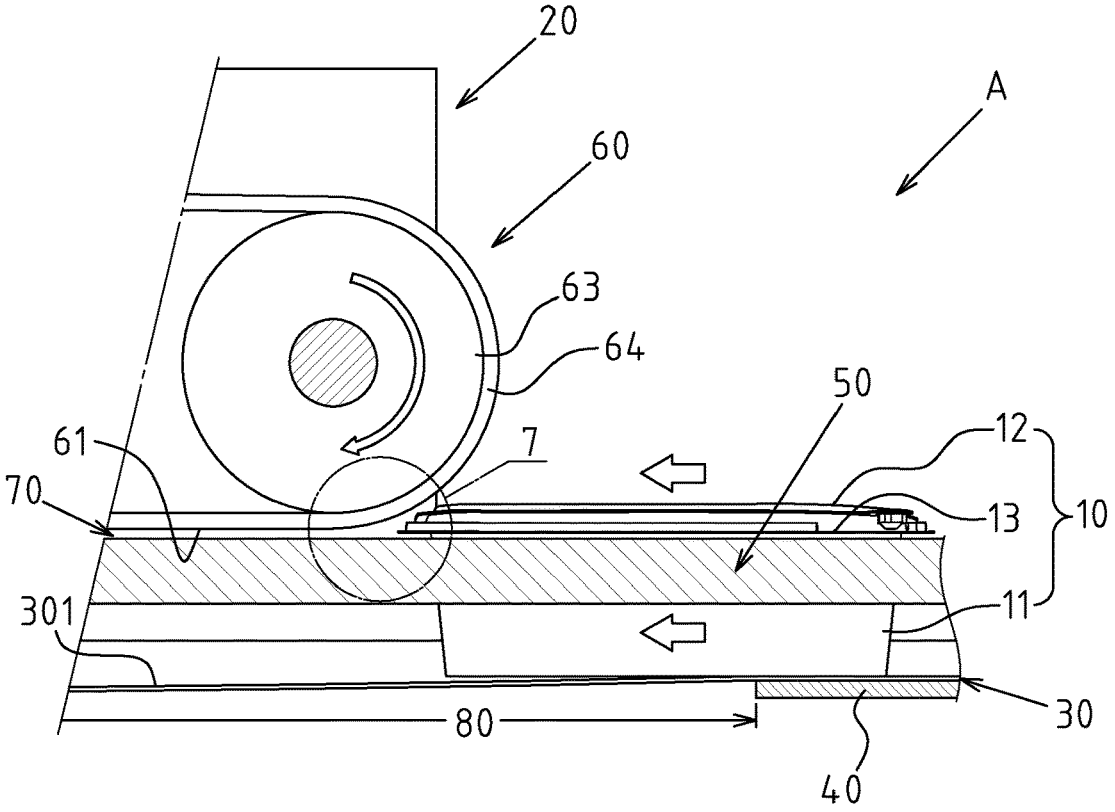
FIG. 6 is a vertical sectional view of the exposed state of the corresponding FIG. 5.

As shown in FIGS. 1 and 3, in this example, the workbench 22 of the main frame body 20 is provided with two rolling mechanisms 60 and two fixed tracks 50 arranged in left and right side interval side-by-side setting type, so that the arrangement spacing of the two fixed tracks 50 is m with the width of the box body 11 of the container 10, so as to form the lateral state maintaining structure of the container; the advantage of the present embodiment is that the other side of the convex frame edge 13 of the cap body 12 of the container 10 can also be rolled, thereby obtaining the better state that the left and the right side can be averagely rolled.

Figure 2:
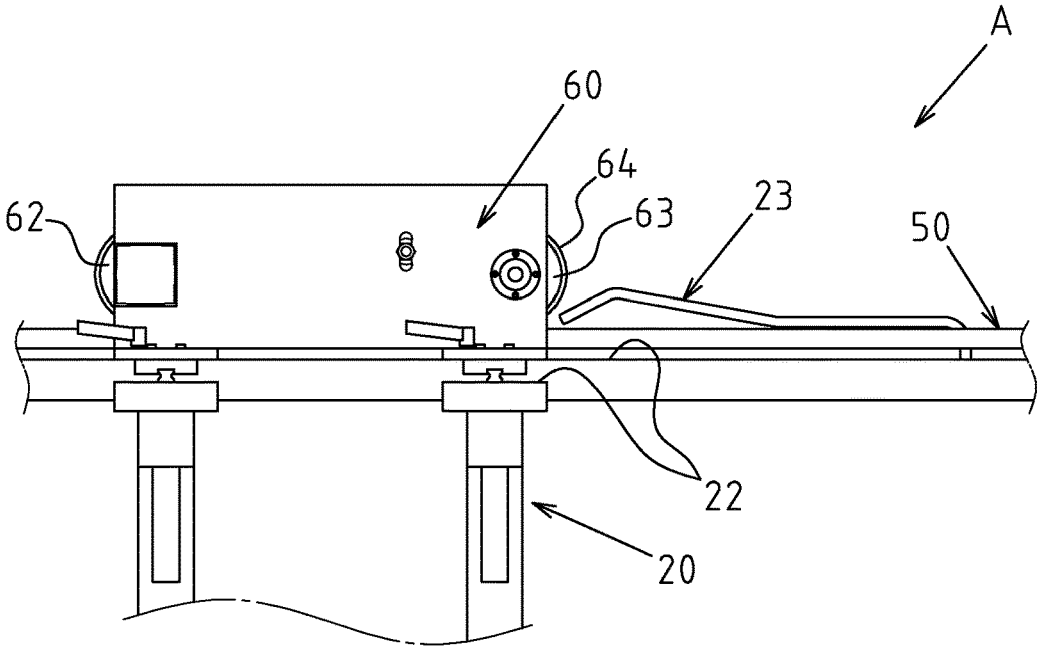
FIG. 2 is a front view of the main part of the preferred embodiment of the present invention.

As shown in FIG. 1-FIG. 3, in this example, the same side of the box body 11 and the cap body 12 is connected to each other through a connecting edge 14, and the cap body 12 is in a uncapping form; the workbench 22 of the main frame body 20 is provided with an auxiliary guide rod for uncapping 23 at a up position corresponding to one of the fixed track 50 and the rolling surface 61 of the rolling mechanism 60. The embodiment disclosed in this example is mainly to provide a preferred guiding structure for the uncapping form of the cap body 12 of the container 10, so that the cap body 12 is changed from the opening angle state to the close angle state by the guidance of the auxiliary guide rod for uncapping 23 before the container 10 is transported to the rolling mechanism 60 along the bottom conveyor belt 30.

Wherein, the bottom conveyor belt 30 has an automatic resetting capability by that the bottom conveyor belt 30 is made of elastic toughness material (such as rubber material), or, an elastic displacement mechanism (note: the illustration is omitted on the figure) is disposed by at least one of the rotating wheel 31 or the rotating wheel 32 arranged in the bottom conveyor belt 30.

As shown in FIG. 1 to FIG. 3, in this example, the rolling mechanism 60 includes a driving wheel 62, a driven wheel 63, and a rolling belt 64 disposed between the driving wheel 62 and the driven wheel 63 in a circular shape. The rolling surface 61 is formed by the bottom of the rolling belt 64.

Figure 9:
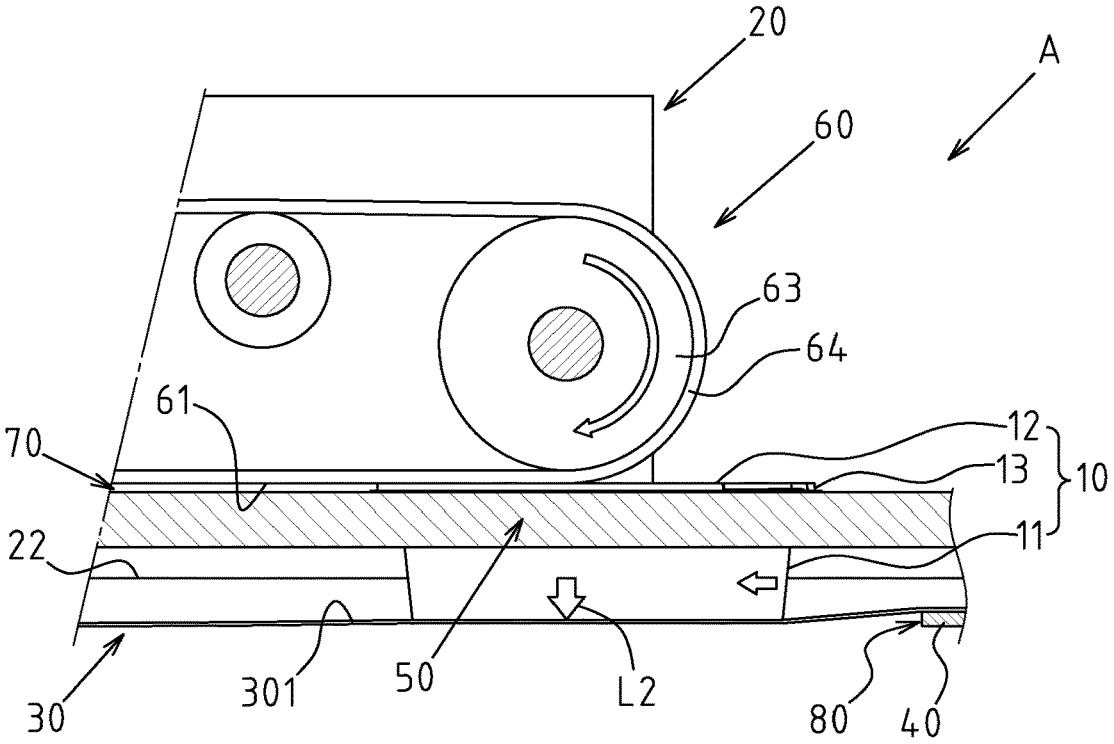
FIG. 9 is a vertical sectional view of the exposed state of the corresponding FIG. 8.
Figure 10:
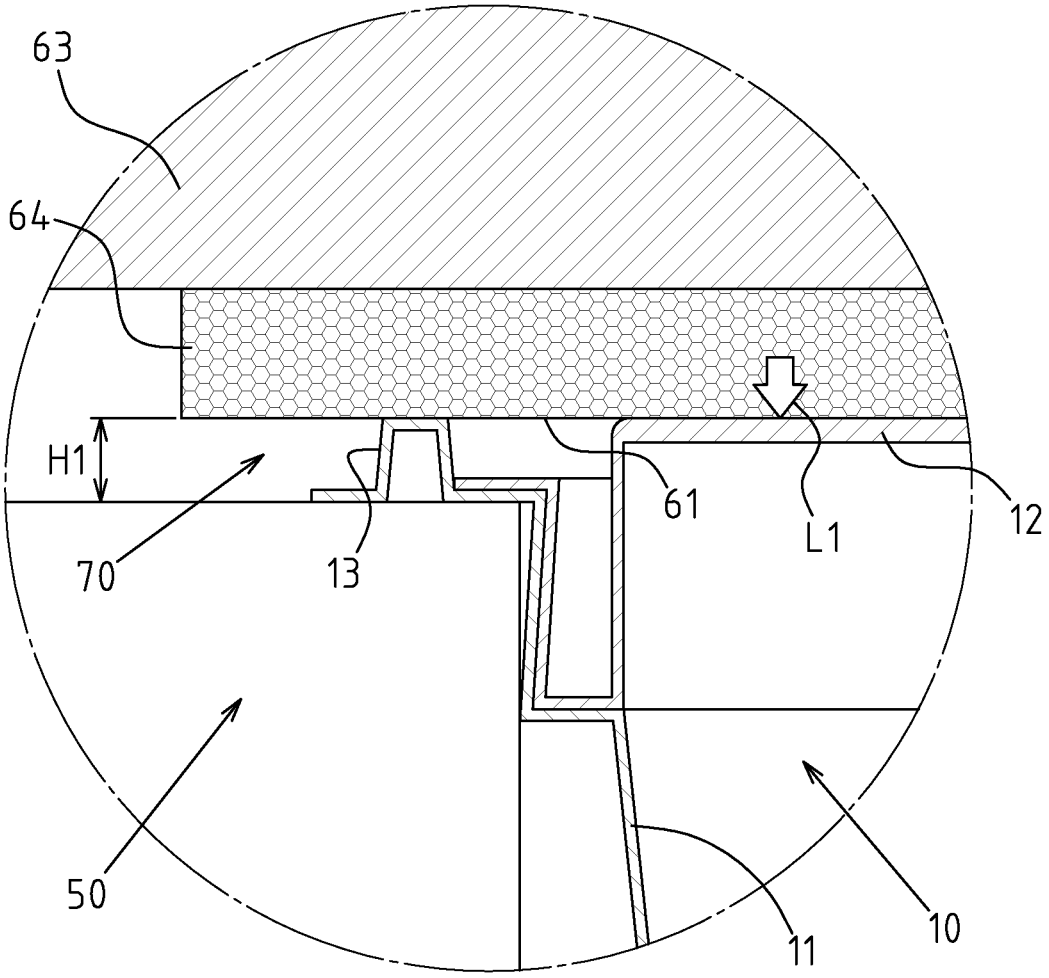
FIG. 10 is a schematic diagram of the rolling and capping state of the rolled surface of the cap body of the container of the corresponding FIG. 9.

With the above-mentioned structural composition and technical features, the preferred embodiment of the automatic capping machine for containers A disclosed in the present invention specifically uses the actuation state as shown in FIG. 1, mainly the container 10 (note: in this example, the cap body 12 is in uncapping state) is placed at the conveying side 301 of the bottom conveyor belt 30. When the bottom conveyor belt 30 is started, the container 10 is transported in the direction of the rolling mechanism 60, and the container 10 is transported through the auxiliary guiding of the rod for uncapping 23, so that the cap body 12 is changed from the opening angle state to the closed angle state; on the other hand, as shown in FIG. 3, the lateral state maintaining structure of the container is formed through that the configuration spacing of the two fixed tracks 50 coincides with the width of the box body 11 of the container 10, so that the convex frame edge 13 disposed in the box body 11 of the container 10 during the transport displacement process can be maintained above the fixed track 50; then, as shown in FIG. 5 to FIG. 10, when the container 10 is transported to the lowering of the rolling mechanism 60 by the bottom conveyor belt 30, the convex frame edge 13 of the box body 11 is just located in the sliding gap 70 (as shown in FIG. 9) formed between the rolling surface 61 and the fixed track 50, at this time, the cap body 12 will be rolled downward (as indicated by Arrow L1 in FIG. 10) and completely capped on the convex frame edge 13 of the box body 11. In this process, if the box body 11 is lowered due to a slightly higher height during the rolling process, with the type feature of the through air collision avoidance section 80, the box body 11 bottom and the corresponding bottom conveyor belt 30 area have an elastic margin that can be pressed down (as indicated by Arrow L2 of FIG. 9), so that the structural rigidity of the box body 11 can be ensured, the deformation of the box body 11 can be prevented, and the friction force driven by the box body 11 can be considered.

Figure 11:
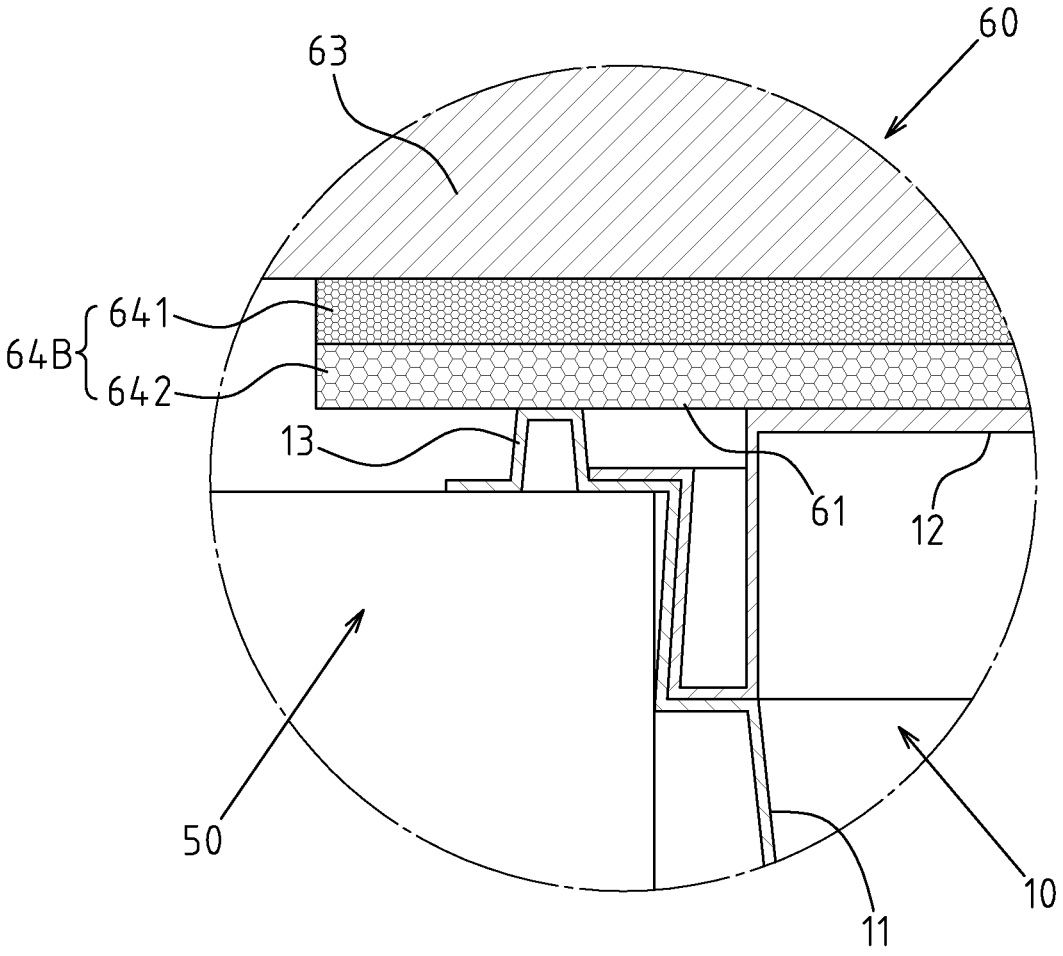
FIG. 11 is an embodiment diagram of the rolling belt of the present invention, which is a composite layer structure.

As shown in FIG. 11, in this example, the rolling belt 64B of the rolling mechanism 60 is a composite layer structure including an inner layer 641 and an outer layer 642, and the material hardness of the outer layer 642 is smaller than the material hardness of the inner layer 641; the advantage of the embodiment disclosed in this example is mainly to make the friction belt power of the rolling belt 64B better, and reduce the excessive rolling damage to the cap body 12 of the container 10; on the other hand, when the top surface heights of the cap body 12 and the convex frame edge 13 of the container 10 show a non-flat state with a high and low drop, the outer layer 642 with a smaller material hardness in this example is designed for softness, it is also able to maintain a balance with both the cap body 12 and the convex frame edge 13 to achieve better rolling and friction driving effect.

Figure 12:
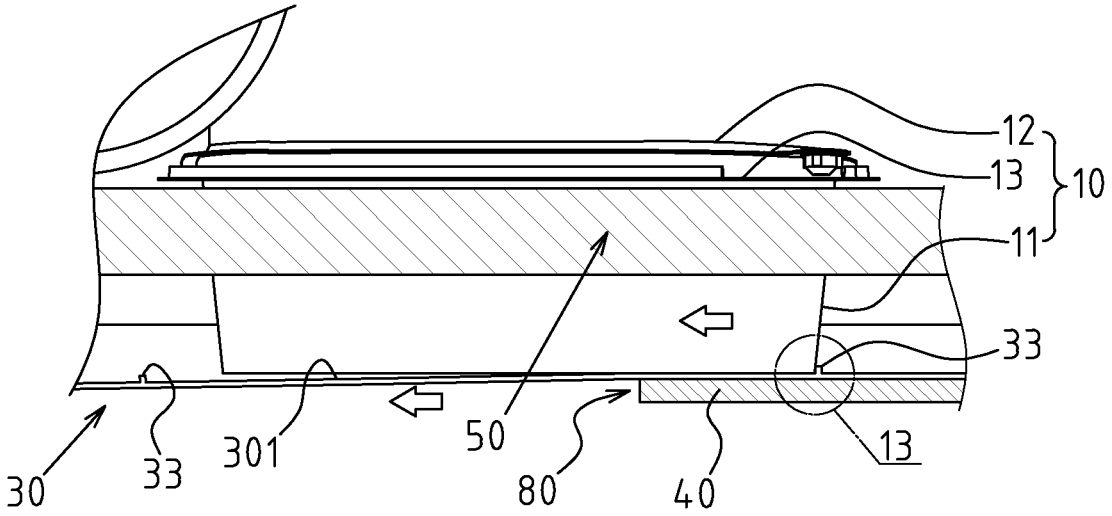
FIG. 12 is an embodiment diagram of the push rib disposed on the bottom conveyor belt surface of the present invention.
Figure 13:
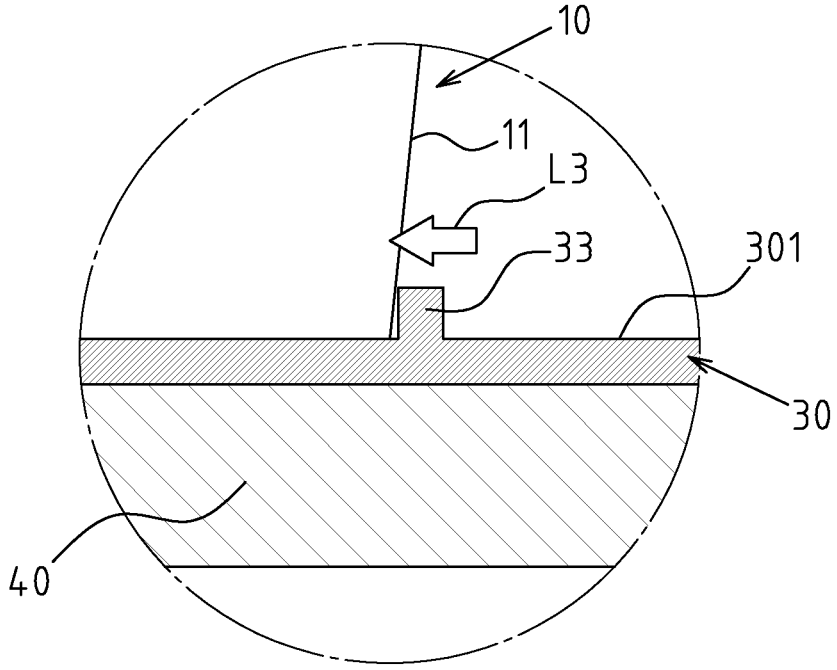
FIG. 13 is a partial enlargement diagram of FIG. 12.

As shown in FIGS. 12, 13, in this example, the surface of the bottom conveyor belt 30 is further provided with a plurality of the push ribs 33 spaced and arranged along its axial circular direction; the setting of the push rib 33 is mainly considered for that the through air collision avoidance section 80 may cause a decrease in the frictional force on the surface of the bottom conveyor belt 30, so that the container 10 forward can be pushed forwards by the added push rib 33 (as shown by Arrow L3 of FIG. 13).

In addition, the at least one lining plate 40 is used to support and limit a minimum height state of the conveying side 301 of the bottom conveyor belt 30 during running, and indirectly limits the minimum bottom height of the convex frame edge 13 disposed in the box body 11, which is constantly kept on top of the fixed track 50.

I claim:

1. An automatic capping machine for capping a container, the container having a box body and a cap body, the box body having an upper opening with a convex frame edge, the cap body being cappable onto the convex frame edge, the automatic capping machine comprising:

a main frame body having a positioning part and a workbench;

a bottom conveyor belt movable circularly along an axial direction and disposed horizontally on the workbench, said bottom conveyor belt having a circular shape between at least a pair of rotating wheels, said bottom conveyor belt having a conveying side and a returning side;

at least one lining plate disposed under the conveying side of said bottom conveyor belt along a running path of the conveying side so as to support the conveying side at a minimum height during running along the running path, said at least one lining plate defining a rolling section thereon;

at least one fixed track horizontally disposed on the workbench of said main frame body such that said at least one fixed track and said bottom conveyor belt extend along a direction in which the container is to be conveyed, said at least one fixed track being located above at least one side of said bottom conveyor belt;

at least one rolling mechanism horizontally disposed on the workbench of said main frame body such that said at least one rolling mechanism and said bottom conveyor belt extend along the direction in which the container is to be conveyed, said at least one rolling mechanism being located above said at least one fixed track, said at least one rolling mechanism having a rolling surface, the rolling surface being spaced from said at least one fixed track therebelow so as to define at least one rolling gap, the at least one rolling gap having a height adapted to match a thickness of the convex frame edge of the box body;

a lateral state maintaining structure disposed above the conveying side of the said bottom conveyor belt, said lateral state maintaining structure adapted as to retain the convex frame edge of the box body above said at least one fixed track; and a through air collision avoidance section formed on the rolling section, said through air collision avoidance section at least covering the rolling surface of said at least one rolling mechanism and adapted such that a bottom of the box body and said bottom conveyor belt have an elastic margin that can be pressed and lowered when the container is transported to said through air collision avoidance section, the elastic margin being less than a minimum distance between the conveying side and the returning side of said bottom conveyor belt.

2. The automatic capping machine of claim 1, wherein said at least one rolling mechanism comprises two rolling mechanisms, said at least one fixed track comprising two fixed tracks arranged in side-by-side relationship, the two fixed tracks being spaced by an interval from each other.

3. The automatic capping machine of claim 1, wherein said bottom conveyor belt is formed of an elastic material.

4. The automatic capping machine of claim 1, wherein said at least one rolling mechanism comprises a driving wheel, a driven wheel, and a rolling belt disposed between the driving wheel and the driven wheel, the rolling belt having a circular shape, the rolling belt having a bottom that forms the rolling surface.

5. The automatic capping machine of claim 4, wherein the rolling belt has a composite layer structure with an inner layer and an outer layer, the outer layer having a hardness that is less than a harness of the inner layer.

6. The automatic capping machine of claim 1, wherein said bottom conveyor belt has a plurality of push ribs on a surface thereof, the plurality of ribs being in spaced relationship to each other.

* * * * *